United States Patent [19]

Ishikawa et al.

[11] Patent Number: 4,954,766

[45] Date of Patent: Sep. 4, 1990

[54] POWER SUPPLY CIRCUIT AND SEMICONDUCTOR INTEGRATED CIRCUIT DEVICE USING IT

[75] Inventors: Shuichi Ishikawa, Kawasaki; Hiromichi Kuwano, Tokyo, both of Japan

[73] Assignee: Texas Instruments Incorporated, Dallas, Tex.

[21] Appl. No.: 377,508

[22] Filed: Jul. 10, 1989

[30] Foreign Application Priority Data

Jul. 11, 1988 [JP] Japan ..... 63-172481

[51] Int. Cl.[5] ..... G05F 1/56

[52] U.S. Cl. ..... 323/272; 323/315; 323/317; 323/350

[58] Field of Search ..... 323/268, 271, 272, 267, 323/312, 315–317, 350–353; 357/44, 51

[56] References Cited

FOREIGN PATENT DOCUMENTS 0047514 4/1980 Japan ..... 323/315

OTHER PUBLICATIONS

Countryman et al., "Constant Current (Current Source) Resistive Ribbon Print Head Array Drive Scheme", IBM Technical Disclosure Bulletin, vol. 22, No. 2, (Jul. 1979), pp. 790–791.

*Primary Examiner*—Peter S. Wong

*Attorney, Agent, or Firm*—William E. Hiller; N. Rhys Merrett; Melvin Sharp

[57] ABSTRACT

This invention relates to a power supply circuit wherein first transistors, resistors, and second transistors with a polarity opposite to that of said first transistors are series-connected between the power supply side and the output side. In one embodiment, the circuit is provided as a semiconductor integrated circuit wherein first transistor elements, diffusion resistor elements, and second transistor elements with a polarity opposite to that of said first transistor elements are respectively formed on a common semiconductor substrate together with interconnects.

12 Claims, 4 Drawing Sheets

POWER SUPPLY CIRCUIT AND SEMICONDUCTOR INTEGRATED CIRCUIT DEVICE USING IT

TECHNICAL FIELD OF THE INVENTION

The present invention relates to a power supply circuit and a semiconductor integrated circuit device using it, and particularly to a constant-current supply circuit and a semiconductor integrated circuit device using it.

BACKGROUND OF THE INVENTION

In the past, for a high voltage withstanding display driver (a circuit in which many current outputs are required), a constant-current supply with a circuit structure as shown in FIG. 5 may be considered. As shown in the figure, on the side of a power supply 3 ($V_{EE}$), the respective emitters of (high potential withstanding) PNP switching transistors $Q_1$, $Q_2$, $Q_3$ . . . and $Q_{34}$ are connected in common, and the bases of the switching transistors $Q_1$, $Q_2$, $Q_3$ . . . and $Q_{34}$ are respectively connected to switches 51, 52, 53 . . . and 84. (This circuit diagram shows a state in which the switches are ON, i.e., the state that the base voltage is OV, for example). Collectors of the switching transistors $Q_1$, $Q_2$, $Q_3$ . . . and $Q_{34}$ are respectively connected through resistors $R_1$, $R_2$, $R_3$ . . . and $R_{34}$ to respective output terminals $T_1$, $T_2$, $T_3$ . . . and $T_{34}$. Each of $Z_1$, $Z_2$, $Z_3$ . . . and $Z_{34}$ in the figure represents a load impedance (e.g., picture element of plasma display), and 5 ($V_{CC}$) indicates a negative power supply.

Referring to a circuit unit 101 (also to 102, 103 . . . and 134) which are the parts shown by a broken line in this circuit diagram, the resistance value of the resistor $R_1$ is increased to increase the voltage drop due to the resistor $R_1$ (assuming that the current flowing $R_1$ is $I_0$, $R_1.I_0$), thereby controlling a change in the power supply 3 and an output current change due to a change in the load impedance $Z_1$. That is, with a change in the power supply 3 as $\Delta V_{EE}$, a change in the output voltage $V_{CC}$ due to a change in the load impedance $Z_1$ as $\Delta V_{CC}$, and a change in the load impedance $Z_1$ as $\Delta Z_1$, we obtain $$I_0 \approx \frac{(V_{EE} + \Delta V_{EE}) - (V_{CC} + \Delta V_{CC})}{R_1 + Z_1 + \Delta Z_1} = \frac{V_{EE} - V_{CC}}{R_1 + Z_1 + \Delta Z_1} + \frac{\Delta V_{EE} - \Delta V_{CC}}{R_1 + Z_1 + \Delta Z_1} \approx \frac{V_{EE} - V_{CC}}{R_1} \text{ (a constant),}$$

(where $R_1 >> Z_1 + \Delta Z_1$; $I_O R_1 >> \Delta V_{EE}$; and $I_O R_1 >> \Delta V_{CC}$). Therefore, with $R_1$ as being large ($I_O R_1 >> \Delta V_{EE}$, $I_O R_1 >> \Delta V_{CC}$), $I_O$ can be almost constant.

However, in a circuit which requires many current outputs (a power supply circuit having 34 current outputs consisting of circuits 101, 102, 103 . . . and 134 shown by broken lines in FIG. 5), since there are many resistors like $R_1$ (e.g., 34 resistors $R_1$, $R_2$, $R_3$ . . . and $R_{34}$) with large resistance values described above, the voltage drop due to the resistance becomes large, wasting power. There is a problem that this amounts for a large portion of power consumption in the above entire display driver. There is also a problem that it is difficult to form many resistors with large resistance values in a semiconductor IC (integrated circuit) with high precision (without dispersion in the resistance value), (that is, it is difficult to output a constant-current).

An object of the invention is to provide a power supply circuit and a semiconductor integrated circuit device using it wherein power consumption is reduced and dispersion of output current is small.

SUMMARY OF THE INVENTION

This invention relates to a power supply circuit wherein first transistors (e.g., NPN transistors $Q_{35}$, $Q_{36}$, $Q_{37}$ . . . and $Q_{68}$, described later), resistors, and second transistors with a polarity opposite to that of said first transistors (e.g., PNP transistors $Q_1$, $Q_2$, $Q_3$ . . . and $Q_{34}$ described later) are series-connected in this order between the power supply side and the output side.

This invention provides a semiconductor integrated device for a power supply circuit wherein first transistor elements, diffusion resistor elements, and second transistor elements with a polarity opposite to that of said first transistor elements are respectively formed on a common semiconductor substrate, and wherein interconnecting lines for connecting said first transistor element, said diffusion resistor elements, and said second transistor elements in series are formed on said semiconductor substrate.

DETAILED DESCRIPTION OF THE EMBODIMENTS

The embodiments of the invention will be now described.

Figure 1:
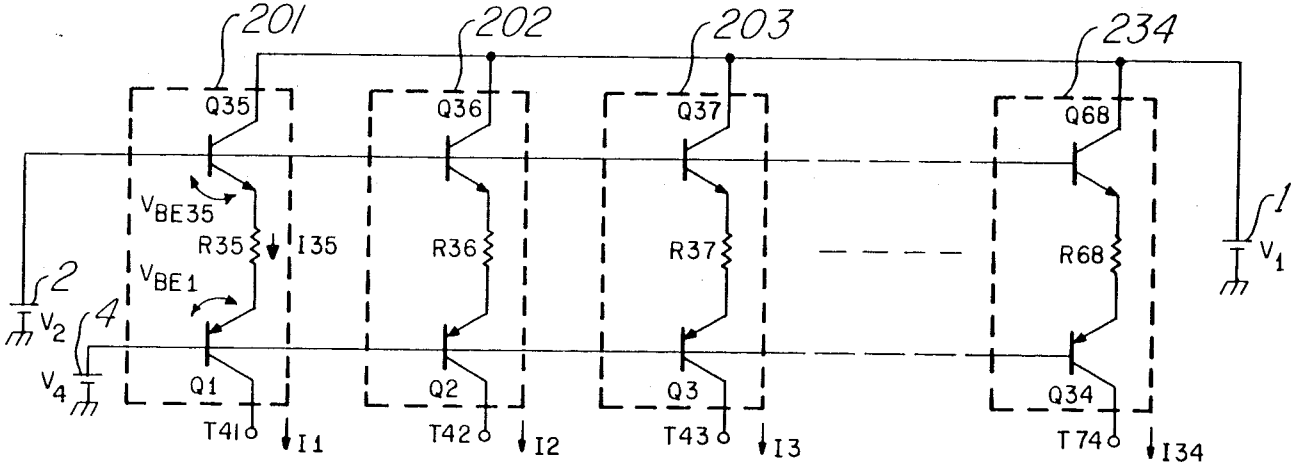
FIG. 1 is an equivalent circuit diagram of a constant-current supply circuit in accordance with a first embodiment of the invention.
Figure 2:
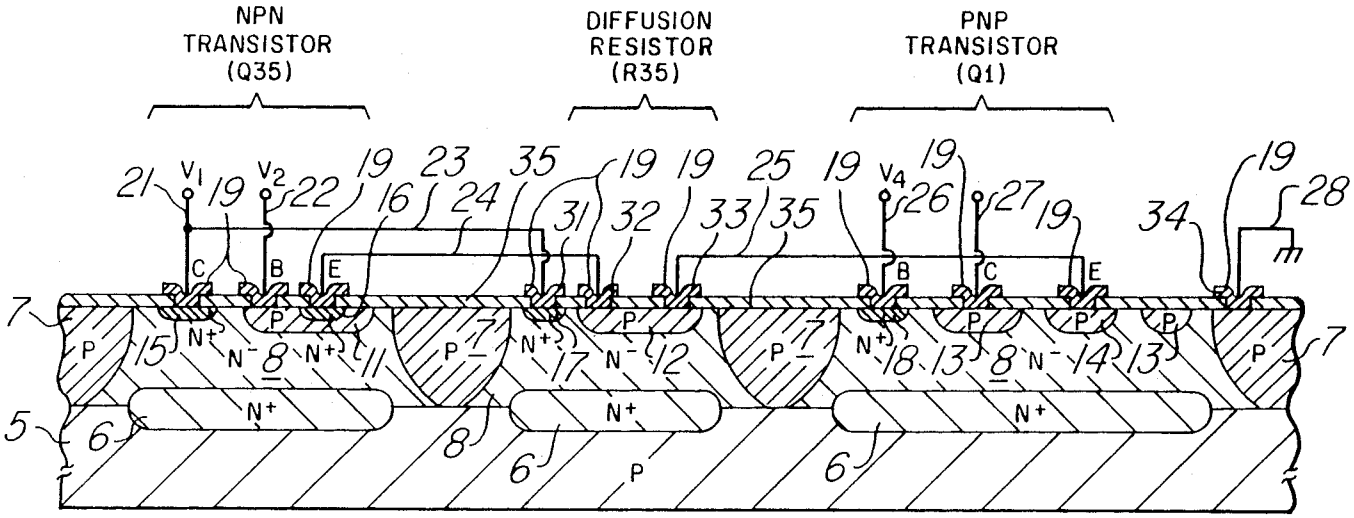
FIG. 2 is a cross-sectional view showing a device structure of FIG. 1, (a cross-sectional view being taken on the plane of lines II—II of FIG. 3 which will be described later)
Figure 3:
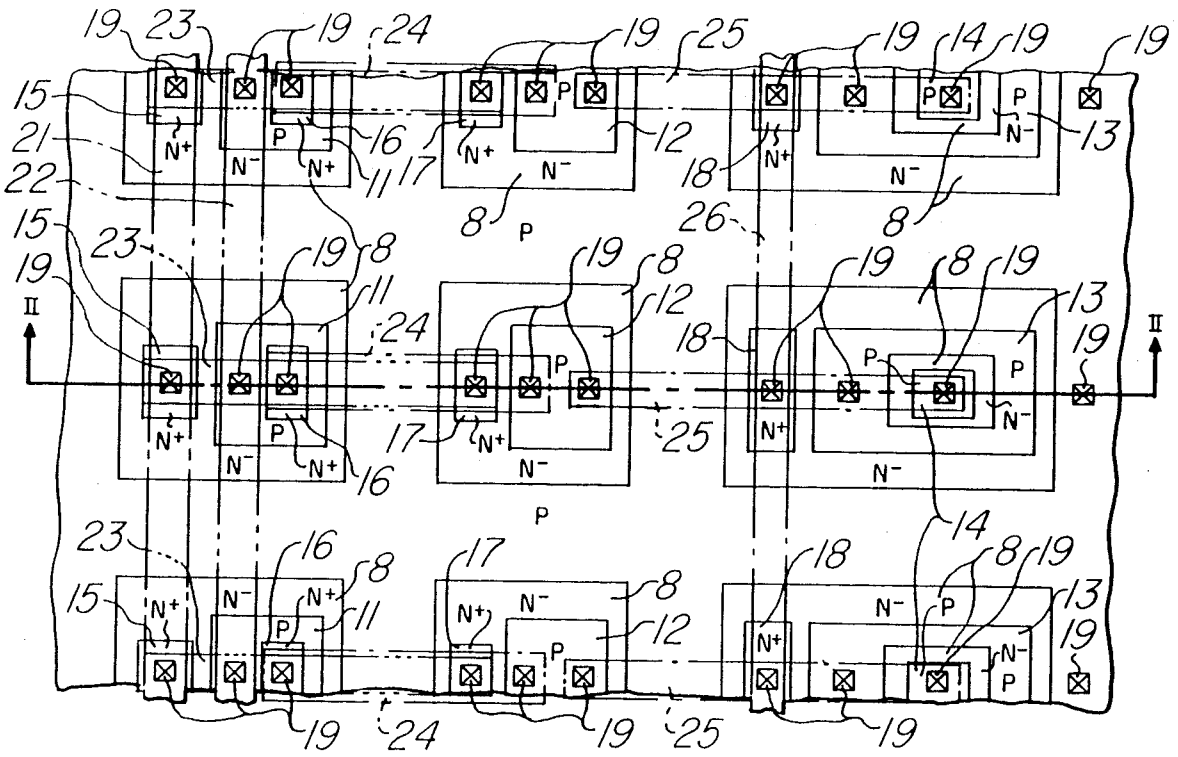
FIG. 3 is a plan view of FIG. 2.

FIGS. 1–3 show a first embodiment of the invention.

Figure 5:
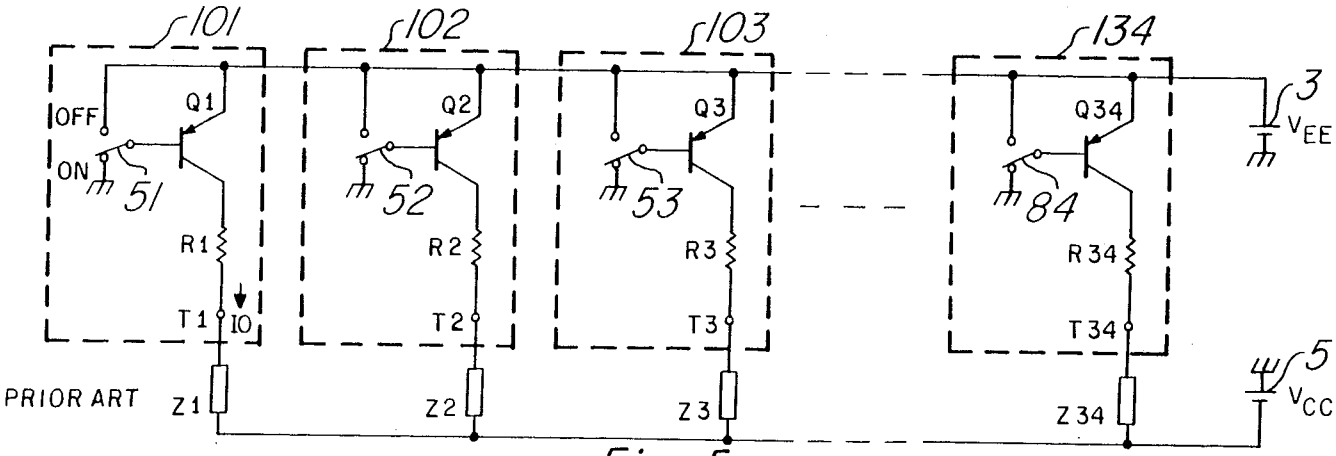
FIG. 5 is an equivalent circuit diagram of a constant-current supply circuit regarded as prior art.

As shown in FIG. 1, a power supply circuit in accordance with this embodiment comprises circuit units 201, 202, 203 . . . and 234 which are shown by broken lines, and has 34 current outputs. A power supply 1 ($V_1$: 5V, for example) is connected with respective collectors of NPN bipolar transistors $Q_{35}$, $Q_{36}$, $Q_{37}$ . . . and $Q_{68}$, with emitters of the transistors $Q_{35}$, $Q_{36}$, $Q_{37}$ . . . and $Q_{68}$ respectively connected through resistors $R_{35}$, $R_{36}$, $R_{37}$ . . . and $R_{68}$ (e.g., each being of approximately 4.3 Kohm) to emitters of PNP bipolar transistors $Q_1$, $Q_2$, $Q_3$ . . . and $Q_{34}$ (which are similar transistors to those in the prior art example in FIG. 5).

Collectors of the transistors $Q_1$, $Q_2$, $Q_3$ . . . and $Q_{34}$ are respectively connected to output terminals $T_{41}$–$T_{74}$. Each of these output terminals is connected to a picture element of a plasma display (not shown: corresponding to $Z_1$–$Z_{34}$ in FIG. 5). Bases of the PNP transistors $Q_{35}$, $Q_{36}$, $Q_{37}$ . . . and $Q_{68}$ and of the PNP transistors $Q_1$, $Q_2$, $Q_3$ . . . $Q_{34}$ are respectively connected in common to a power supply 2 ($V_2$: +2.7 V, for example) and a power supply 4 ($V_4$) or OV (earth). $I_1$, $I_2$, $I_3$ . . . and $I_{34}$ (e.g., each being of 250 uA) represent output currents.

In the structure as described above, the circuit 201 indicated by a broken line will be now described (other circuits 202, 203 . . . and 234 can be also described in like manner).

Considering the case that the collector current $I_{C35}$ (not shown) of the NPN transistor $Q_{35}$ will be increased by the change of the power supply 1 ($V_1$):

(1) When the collector current $I_{C35}$ is increased. $I_{E35}$ is increased according to the relative equation of $I_{E35}=I_{C35}+I_{B35}$, (where $I_{E35}$ represents the emitter current and is not shown);

(2) When $I_{E35}$ is increased, the voltage on both ends of (the voltage across) the resistor $R_{35}$ is increased;

(3) When the voltage on both ends of resistor $R_{35}$ is increased, the base-emitter voltage $V_{BE35}$ and further the base-emitter voltage $V_{BE1}$ of the PNP transistor $Q_1$ become smaller; and (4) When the voltage $V_{BE35}$ and further the base-emitter voltage $V_{BE1}$ of the PNP transistor $Q_1$ become smaller, the collector current $I_{C35}$ also becomes smaller.

Therefore, when a change in the power supply 1 ($V_1$) causes the collector current $I_{C35}$ of the transistor $Q_{35}$ to increase, the increase will be restrained. Conversely, when a change in the power supply 1 ($V_1$) causes the collector current $I_{C35}$ of the transistor $Q_{35}$ to decrease, it can be described by the reversed operation of the above (1)–(4), and the decreased of the collector current $I_{C35}$ is restrained. Since beta, grounded-emitter current amplification factor, of the NPN transistor $Q_{35}$ is high, more than 100, the small current output from the power supply 2 ($V_2$) can be sufficient, and many NPN transistors can be connected.

Next, considering the case that a change in the load impedance on the output side (not shown in FIG. 1) increases the collector current $I_{Cl}$ of the PNP transistor $Q_1$ (i.e., the output current $I_1$):

(1) When the collector current $I_{Cl}$ is increased, the emitter current $I_{E1}$ is increased;

(2) When the emitter current $I_{E1}$ is increased, the voltage of both ends of the resistor $R_{35}$ becomes larger;

(3) When the voltage of both ends of the resistor $R_{35}$ becomes larger, the base-emitter voltage $V_{BE1}$ and further the base-emitter voltage $V_{BE35}$ of the NPN transistor $Q_{35}$ become smaller;

(4) When the base-emitter voltage $V_{BE1}$ and further the base-emitter voltage $V_{BE35}$ of the NPN transistor $Q_{35}$ become smaller, the collector current $I_{Cl}$ also becomes smaller. (The collector current $I_{C1}$, the emitter current $I_{E1}$, and the base current $I_{B1}$ are not shown.)

Therefore, when a change in the load impedance on the output side causes the collector current $I_{Cl}$ (the output current $I_1$) of the transistor $Q_1$ to increase, the increase will be restrained. Conversely, when a change in the load impedance on the output side causes the collector current $I_{Cl}$ of the transistor $Q_1$ to decrease, it can be described by the reversed operation of the above (1)–(4), and the decrease of the collector current $I_{Cl}$ (the output current $I_1$) is restrained.

In addition to the above, since the NPN transistor $Q_{35}$ and the PNP transistor $Q_1$ are reversely biased between their respective collectors and bases, changes in the respective collector currents of the transistor $Q_{35}$ and the transistor $Q_1$ due to changes in the power supply 1 ($V_1$) and in the load impedance can be restrained, (i.e., this means that the input impedance of respective collectors of the NPN transistor $Q_{35}$ and the PNP transistor $Q_1$ is very large).

Assuming that the transistor $Q_1$ and the transistor $Q_{35}$ are under the condition that they operate in their saturation region, the current $I_{35}$ flowing through the transistor $R_{35}$ is determined by:

$$I_{35} = \frac{(V_2 - V_{BE35}) - (V_4 + V_{BE1})}{R_{35}},$$

(where, with the transistor $Q_1$ as grounded-base, the effect of dispersion of $h_{FE}$ can be small; and with grounded-base current amplification factor of $Q_1$ as alpha, the output current $I_1$ is $I_1$=alpha $I_{35}$). Therefore, the resistor $R_{35}$ produces the current $I_{35}$ by the voltage between the power supply 2 ($V_2$) and the power supply 4 ($V_4$) (i.e., it corresponds to the numerator of the above equation).

Since the resistor $R_{35}$ has a temperature coefficient of resistance value opposite to that of $V_{BE35}$ and $V_{BE1}$, the current change according to the temperature is small (that is, the temperature coefficient of the base-emitter voltages $V_{BE35}$ and $V_{BE1}$ of the above transistor $Q_{35}$ and transistor $Q_1$ are respectively negative, and therefore, in the equation determining the above $I_{35}$, since the signs of the temperature coefficients of the denominator and the numerator are the same, the current change becomes small).

As described above, with the circuit of the embodiment, the NPN transistor $Q_{35}$ and the resistor $R_{35}$ can restrain the change in the collector current of transistor $Q_{35}$ due to the change in the power supply 1 ($V_1$), and further the resistor $R_{35}$ can restrain the change in the current (which flows across the resistor $R_{35}$) due to the change in the power supply 2 ($V_2$) and the power supply 4 ($V_4$). The PNP transistor $Q_1$ and the resistor $R_{35}$ can restrain the change in the collector current (i.e., the output current $I_1$) of the transistor $Q_1$ due to the change in the load impedance on the output side, so that a certain constant current (i.e., $I_1=I_2=I_3=$. . . and $I_{34}$) can be always supplied on the output side. Since the resistor with high resistance value is not required, the increase in the power consumption due to the voltage drop of the resistor can be limited to a small amount.

In FIGS. 2 and 3, the structure of the device in accordance with the embodiment will be described.

An N− type epitaxial layer 8 is formed above one main face of a P type silicon substrate 5 with an N+ type buried layer 6 in between; and an N+ type diffusion region 15 and a P type diffusion region 11 are formed in the N− type epitaxial layer 8; and an N+ type diffusion region 16 is formed in the P type diffusion region, respectively constituting a collector region, a base region, and an emitter region, to provide an NPN bipolar transistor $Q_{35}$.

Similarly, a P type diffusion region 12 is formed to provide a diffusion resistor $R_{35}$ in the epitaxial layer 8 which is formed above the one main face of the P type silicon substrate 5 with the N+ type buried layer 6 in between.

An N+ type diffusion region 18, a P type diffusion region 13 and a P type diffusion region 14 are provided in the N− type epitaxial layer 8, which is provided above the one main surface of the P type silicon substrate 5 with the N+ type buried layer 6 in between. The regions 18, 13, and 14 are respectively form the base region, the collector regions, and the emitter region, to form a PNP bipolar transistor $Q_1$.

For the reference numerals shown in the figure, 7 represents a P type isolation region, 17 represents an $N^+$ type diffusion region, 19 represents a contact hold, 21–28 respectively represent interconnecting lines of aluminum and so on formed on the semiconductor substrate, 31–34 represent electrodes, 35 represents insulating layer, 8 represents a base electrode, C represents a collector electrode, and E represents an emitter electrode.

Since by reversely biasing the PN junction of the NPN transistor, the diffusion resistor (the P type diffusion region 12) is isolated, the $N^-$ type epitaxial layer 8 is connected to the highest potential (the power supply $V_1$) with the interconnecting line 23. The P type silicon substrate 5 is connected to the lowest potential (i.e., the P type region 7) with the interconnecting line 28.

As described above, with the device of the embodiment, the NPN type bipolar transistor, the diffusion resistor and the PNP type bipolar transistor are respectively formed on the common semiconductor substrate, series-connected so that many similar NPN type bipolar transistors, many similar diffusion resistors, and many similar PNP type bipolar transistors can be closely arranged. Therefore, voltage between the base and emitter and amplification factors of current of each transistor and the dispersion of the resistance value of each diffusion resistor can be small, and the dispersion of current of each output can be small (i.e., $I_1 \approx I_2 \approx I_3 = \ldots$ and $= I_{34}$). Especially, $h_{FE}$ of the PNP transistor is about 10–50, as compared to that of the NPN transistor, so that the effect of $I_B$ can not be ignored because it easily cause the dispersion, but when each PNP transistor is closely arranged in the same chip as in the device of the embodiment, the dispersion of $I_C$ is small.

Figure 4:
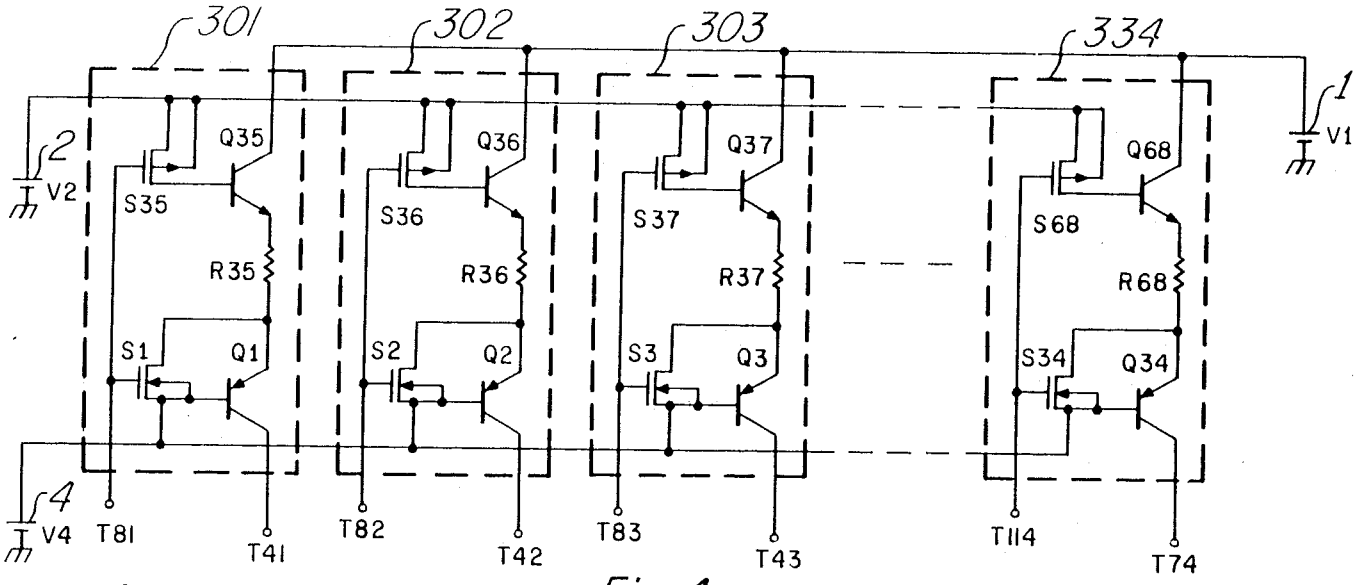
FIG. 4 is an equivalent circuit diagram showing another embodiment of the invention.

FIG. 4 shows another embodiment, wherein a MOS transistor for turning the output current ON and OFF is connected to the above embodiment of FIG. 1.

Drains (or sources) of the P-channel type MOS transistors $S_{35}$–$S_{68}$ and the substrate (a back gate) are respectively connected to the power supply 2 ($V_2$), and their gates are respectively connected to control terminals $T_{81}$–$T_{114}$. The remaining sources (or drains) of transistors $S_{35}$, $S_{36}$, $S_{37}$ . . . $S_{68}$ are respectively connected to the bases of the NPN bipolar transistors $Q_{35}$, $Q_{36}$, $Q_{37}$ . . . and $Q_{68}$.

Drain (or sources) of the N-channel transistors $S_1$–$S_{34}$ and the substrate (a back gate) are respectively connected to the power supply 4 (and further to the PNP bipolar transistors $Q_1$, $Q_2$, $Q_3$ . . . and $Q_4$), and their gates are respectively connected to the control terminals $T_{81}$, $T_{82}$, $T_{83}$ . . . and $T_{114}$. The remaining sources (or drains) of transistors $S_1$, $S_2$, $S_3$ . . . and $S_4$ are respectively connected to the emitters of the PNP bipolar transistors $Q_1$–$Q_{34}$. The rest of the structure is the same as in the embodiment in FIG. 1.

In the structure described above, the operation of a circuit 301 shown by a broken line will be described (and as for the other circuits 302, 303 . . . and 304, they may be described in like manner).

When the voltage $V_4$ which equals that of the power supply 4 is applied to the control terminals $T_{81}$, the P-channel type MOS transistor $S_{35}$ is on to apply the voltage $V_2$ to the base of the NPN bipolar transistor $Q_{35}$ and to turn the transistor $Q_{35}$ on. The N-channel type MOS transistor $S_1$ is off to apply a voltage to the emitter of the PNP bipolar transistor $Q_1$ through the base and emitter of the transistor $Q_{35}$ and the resistor $R_{35}$ so as to forwardly bias between the base and emitter of the transistor $Q_1$, and to turn the transistor $Q_1$ on. Therefore, the predetermined current will flow from the output terminal $T_{41}$.

When the voltage $V_1$ which equals to that of the power supply 1 is applied to the control terminal $T_{81}$, the P-channel type MOS transistor $S_{35}$ is off, so that the voltage $V_2$ is not applied to the base of the NPN bipolar transistor $Q_{35}$, to be turned off. The N-channel type MOS transistor $S_1$ is on, so that the potential between the emitter and base of the bipolar transistor $Q_1$ is almost the same, the transistor $Q_1$ being off. Therefore, no current will flow from the output terminal $T_{41}$.

While the embodiment of the invention has been described, the above embodiments can be further modified according to the technical thought of the invention.

For example, while in the embodiments described above, the NPN type transistor, the resistor and the PNP type transistor are series-connected between the power supply side and the output side in this order, the connection order between the NPN type transistor and the PNP type transistor may be reversed depending on the polarity of the power supply and so on.

MOS transistors can be used as transistors, and appropriate structures, such as MOS transistors can also be used as resistors. The conductivity type of each semiconductor region may be changed. The power supply circuit of the invention can be applied for the use other than described above.

EFFECTS OF THE INVENTION

In the invention, as described above, the first transistor, the resistor, and the second transistor having the polarity opposite to that of the above first transistor, are series-connected in this order between the power supply side and the output side, so that constant current with small power consumption can be supplied without providing the resistor with the high resistance value in the output side. The first transistor element, the diffusion resistor element, and the second transistor element having the polarity opposite to that of the above first transistor element are respectively formed on the common semiconductor substrate, so that the dispersion of the transistor elements and diffusion resistor elements can be small. Therefore, a semiconductor integrated circuit device for a power supply circuit with the small dispersion of the output current can be provided.

What is claimed is:

1. A power supply circuit comprising:

a first bipolar transistor;

a second bipolar transistor having a polarity opposite to that of said first bipolar transistor;

each of said first and second bipolar transistors having an emitter, a base and a collector;

one of the emitter and the collector of said first bipolar transistor being the input thereof and being connectable to a power supply for controlling the voltage change of the power supply;

said one of the emitter and the collector of said second bipolar transistor being the output thereof and being connectable to an output terminal; and a resistor interposed between said first and second bipolar transistors and being connected at one end thereof to the other of the emitter and the collector of said first bipolar transistor as the output thereof and at the other end thereof to the said other of the emitter and the collector of said second bipolar transistor as the input thereof for controlling the voltage change of the power supply.

2. A power supply circuit as set forth in claim 1, wherein said first bipolar transistor has an N-type emitter, a P-type base and an N-type collector; and said second bipolar transistor has a P-type emitter, an N-type base and a P-type collector;

said one of the emitter and the collector of said first and second bipolar transistors being the collector.

3. A power supply circuit as set forth in claim 1, wherein the base of said first bipolar transistor and the base of said second bipolar transistor are respectively adapted to the provided with independent base voltages.

4. A power supply circuit as set forth in claim 1, further including a plurality of stages electrically connected in parallel; and each stage including said first and second bipolar transistors, and said resistor interposed therebetween, with said one of the emitter and the collector of said second bipolar transistor as the output thereof being connectable to a respective output terminal.

5. A power supply circuit as set forth in claim 4, wherein said plurality of stages electrically connected in parallel comprises significantly more than two stages in number so as to provide multiple current outputs.

6. A power supply circuit as set forth in claim 5, further including a single semiconductor substrate;

each of said plurality of stages being implemented in said single semiconductor substrate, wherein the power supply circuit is provided as a semiconductor integrated circuit device.

7. A power supply circuit as set forth in claim 4, further including switching means connected to the base of said first and second bipolar transistors in each of said plurality of stages.

8. A power supply circuit as set forth in claim 7, wherein said plurality of stages electrically connected in parallel comprises significantly more than two stages in number so as to provide multiple current outputs.

9. A power supply circuit as set forth in claim 8, further including a single semiconductor substrate;

each of said plurality of stages being implemented in said single semiconductor substrate, wherein the power supply circuit is provided as a semiconductor integrated circuit device.

10. A power supply circuit as set forth in claim 7, wherein said switching means comprises:

a first field effect transistor;

a second field effect transistor having a polarity opposite to that of said first field effect transistor;

each of said first and second field effect transistors having a gate, a source and a drain;

a control terminal connected to the gates of said first and second field effect transistors;

one of the source and the drain of said first field effect transistor being connected to the base of said first bipolar transistor;

said one of the source and the drain of said second field effect transistor being connected to the base of said second bipolar transistor;

the other of the source and the drain of said first field effect transistor being connectable to an independent power supply;

the other of the source and the drain of said second field effect transistor being connected to the input of said second bipolar transistor;

the base of said second bipolar transistor being connectable to another independent power supply; and said first and second field effect transistors being alternatively rendered conductive and non-conductive in response to voltages applied to said control terminal corresponding to the voltage as respectively obtain from the said another independent power supply connectable to the base of said second bipolar transistor and the power supply connectable to the input of said first bipolar transistor.

11. A power supply circuit as set forth in claim 10, wherein said plurality of stages electrically connected in parallel comprises significantly more than two stages in number so as to provide multiple current output.

12. A power supply circuit as set forth in claim 11, further including a single semiconductor substrate;

each of said plurality of stages being implemented in said single semiconductor substrate, wherein the power supply circuit is provided as a semiconductor integrated circuit device.

* * * * *